US007467636B2

(12) United States Patent
Welch

(10) Patent No.: US 7,467,636 B2
(45) Date of Patent: Dec. 23, 2008

(54) DISHWASHER PUMP AND FILTRATION SYSTEM

(75) Inventor: Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 697 days.

(21) Appl. No.: 10/929,783

(22) Filed: Aug. 31, 2004

(65) Prior Publication Data

US 2006/0042668 A1 Mar. 2, 2006

(51) Int. Cl.
*B08B 3/00* (2006.01)
*B08B 3/12* (2006.01)
*B08B 6/00* (2006.01)

(52) U.S. Cl. ..... 134/111; 134/184; 134/186; 134/115 G

(58) Field of Classification Search ..... 134/57 D, 134/58 D, 111, 115 G, 184, 186, 103.1, 104.1, 134/104.4, 109, 115 R, 121
See application file for complete search history.

(56) References Cited

U.S. PATENT DOCUMENTS

| | | | |
|---|---|---|---|
| 4,319,599 | A | 3/1982 | Dingler et al. |
| 4,350,306 | A | 9/1982 | Dingler et al. |
| 4,468,333 | A | 8/1984 | Geiger |
| 4,559,959 | A | 12/1985 | Meyers |
| 4,612,947 | A | 9/1986 | Duncan |
| 4,673,441 | A | 6/1987 | Mayers |
| 4,972,861 | A | 11/1990 | Milocco et al. |
| 5,097,855 | A | 3/1992 | Martinsson et al. |
| 5,165,433 | A | 11/1992 | Meyers |
| 5,320,120 | A | 6/1994 | Hoffman et al. |
| 5,333,631 | A | 8/1994 | Kirkland et al. |
| 5,377,707 | A | 1/1995 | Young, Jr. |
| 5,433,232 | A | 7/1995 | Young, Jr. |
| 5,450,868 | A | 9/1995 | Young, Jr. |
| 5,499,640 | A | 3/1996 | Kirkland |
| 5,566,696 | A | 10/1996 | Dries et al. |
| 5,579,790 | A | 12/1996 | Edwards et al. |
| 5,601,660 | A | 2/1997 | Jeon et al. |
| 5,609,172 | A | 3/1997 | Chang et al. |
| 5,628,334 | A | 5/1997 | Edwards et al. |
| 5,700,329 | A | 12/1997 | Edwards et al. |
| 5,711,326 | A | 1/1998 | Thies et al. |
| 5,730,805 | A | 3/1998 | Bertsch et al. |
| 5,762,080 | A | 6/1998 | Edwards et al. |

(Continued)

*Primary Examiner*—Michael Barr
*Assistant Examiner*—Rita R Patel
(74) *Attorney, Agent, or Firm*—John Morrison; Michael D. Lafrenz

(57) ABSTRACT

A dishwasher includes a pump assembly having a multi-stage filtering arrangement which functions to trap soil particles contained in a washing fluid to reduce the number of fresh water fills required to perform a washing operation. All of the washing fluid is initially directed over a filter plate. A first portion of the washing fluid passes the filter plate into a pumping chamber, while a second, soil laden portion, enters a first filter chamber. The second portion is then directed through a medium filter into the intake chamber. The filtered washing fluid is pumped through a conduit to wash arms that spray the washing fluid onto kitchenware. The conduit includes a sampling port which directs a portion of the washing fluid to a second filtering compartment having a fine mesh screen. At the end of the washing operation, the washing water, along with the soil is expelled from the dishwasher.

18 Claims, 9 Drawing Sheets

U.S. PATENT DOCUMENTS

| | | | | |
|---|---|---|---|---|
| 5,779,812 | A | 7/1998 | Thies et al. | |
| 5,803,100 | A | 9/1998 | Thies | |
| 5,900,070 | A | 5/1999 | Jarvis et al. | |
| 5,909,743 | A | 6/1999 | Thies et al. | |
| 5,924,432 | A | 7/1999 | Thies et al. | |
| 6,103,017 | A | 8/2000 | Thies et al. | |
| 6,615,853 | B2 | 9/2003 | Hegeman et al. | |
| 6,811,617 | B2 | 11/2004 | Elick et al. | |
| 6,997,193 | B2 | 2/2006 | Elick et al. | |
| 7,146,992 | B2 | 12/2006 | Elick et al. | |
| 7,252,101 | B2 * | 8/2007 | Elick et al. | 134/111 |
| 2004/0159337 | A1 | 8/2004 | Johnson et al. | |
| 2004/0159338 | A1 | 8/2004 | Elick et al. | |
| 2006/0174916 | A1 | 8/2006 | Hedstrom et al. | |
| 2006/0174924 | A1 | 8/2006 | Hedstrom et al. | |

* cited by examiner

DISHWASHER PUMP AND FILTRATION SYSTEM

BACKGROUND OF THE INVENTION

1. Field of the Invention

The present invention pertains to the art of dishwashers and, more particularly, to a pump and filtration system employed in a dishwasher.

2. Discussion of the Prior Art

In a typical dishwasher, washing fluid is pumped from a sump into upper and lower wash arms such that kitchenware retained on vertically spaced racks within a tub of the dishwasher will be sprayed with the washing fluid for cleaning purposes. The washing fluid is heated, filtered and recirculated. Prior to recirculating the washing fluid, the fluid is directed through one or more filters to remove soil from the fluid, with the soil being collected in a chamber. Periodically, the system will be purged in order to drain the collection chamber of the soil.

In recent years, it has become increasingly common to provide a series of straining or filtering units in connection with an overall dishwasher pumping system such that different sized soil particles are collected at varying locations. For example, a strainer can be employed to retain large soil particles, while a fine filter can be utilized to remove smaller particles. That is, the smaller particles are able to pass through the strainer, which essentially constitutes a first filtering unit, and are caught by the second or fine filter. In connection with the pumping and filtering operation, it is also known to incorporate a mincer or chopper in order to minimize soil particle size, such as just prior to a drainage operation.

Obviously, the ability of the dishwasher to thoroughly clean the kitchenware will depend on a number of factors, including the actual configuration and flow of fluid through the filtering system, as well as the manner in which pumping and draining operations are performed. Although various dishwasher pump and filtration systems are known in the art, there still exists a need for improvements in this field in order to further enhance the overall cleaning functions performed by dishwashers.

SUMMARY OF THE INVENTION

The present invention is directed to a pump and filtration system for a dishwasher. In accordance with a preferred embodiment of the invention, an overall dishwasher pump system includes two separate pumps, one for providing a recirculation flow of washing fluid and the other being utilized during draining or purging operations. Most preferably, all of the washing fluid to be recirculated flows over a filter plate arranged in bottom wall of a washing chamber which allows a first portion of the washing fluid to enter a recirculation pump. A second portion of the washing fluid is directed over the filter plate, carrying soil particles too large to pass through the filter plate, into a first filter chamber.

In accordance with a preferred form of the invention, the first filter chamber includes a substantially cylindrical filter provided with a medium mesh filtering screen for entrapping soil particles from the washing fluid, while permitting cleansed washing fluid to be directed, radially outward into the washing chamber. With this arrangement, the first and second portions of washing fluid inter-mix in the washing chamber and are thereafter directed to a pumping chamber portion of a pump housing. The recirculation pump directs the washing fluid to upper and lower wash arms for spraying onto kitchenware being washed in the dishwasher. More specifically, a portion of the washing fluid is passed through a conduit leading from the pump housing to the lower wash arm. This conduit includes a sampling port for directing a portion of the washing fluid into a second or fine filter chamber. The second filter chamber includes a top wall or cover having a plurality of openings provided with a fine mesh filtering screen for entrapping soil particles while, at the same time, permitting cleansed washing fluid to be directed back into the washing chamber. With this arrangement the washing fluid undergoes a three stage filtering process which enables the dishwasher to perform a washing operation to minimize the need for multiple fills of fresh clean water.

In further accordance with the most preferred embodiment, the first filter chamber includes a passage that directs the soil trapped by the medium mesh filtering screen to a soil collection chamber. Likewise, the second filter chamber includes a fine particle soil collection compartment provided with a spring biased valve that, during a drain operation, opens into the soil collection chamber. Actually, the soil collection chamber is a first portion of an overall drain chamber including a soil collection portion, a chopping portion and a drain pump.

At selected times during the washing operation, a drain operation is indicated. At such times, a drain pump is activated to withdraw washing fluid from the dishwasher to a drain. When the drain pump is activated, pump pressure opens the spring biased valve, thereby causing the soil collected in the fine particle soil collection compartment to drop into the soil collection chamber. The soil from the fine soil collection compartment mixes with the soil in the soil collection chamber and is then passed through a chopper plate that minces the soil into even finer particles. These finer particles, in combination with the washing fluid, are then directed to the drain. With this arrangement, soil accumulated during the dishwashing operation is expelled from the dishwasher in such a manner as to prevent a clog from forming in the drain.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
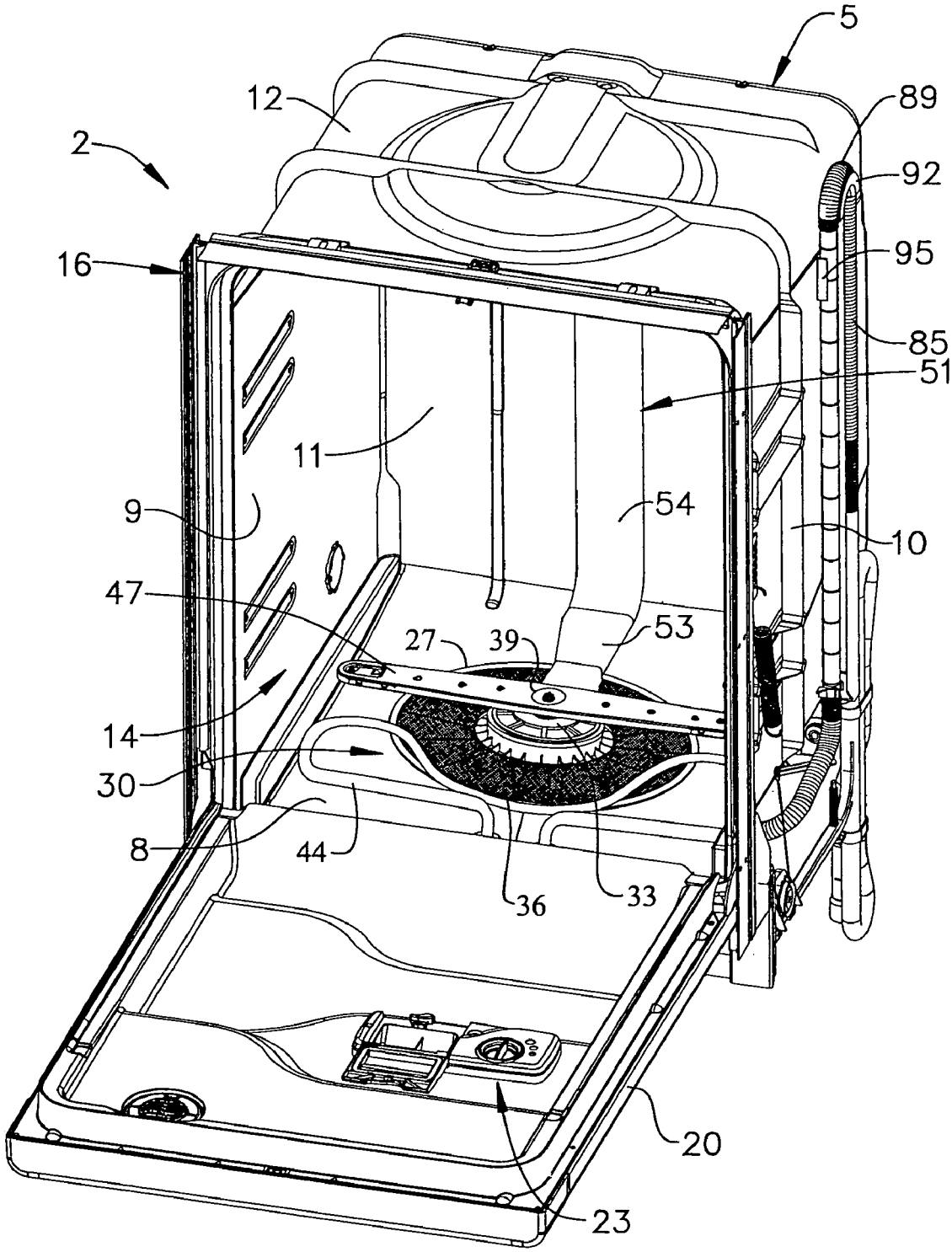
FIG. 1 is an upper right perspective view of a dishwasher constructed in accordance with the present invention, with a door of the dishwasher being open.

With initial reference to FIG. 1, a dishwasher constructed in accordance with the present invention is generally indicated at 2. As shown, dishwasher 2 includes a tub 5 which is preferably injection molded of plastic so as to include integral bottom, side, rear and top walls 8-12 respectively. Within the confines of walls 8-12, tub 5 defines a washing chamber 14 within which soiled kitchenware is adapted to be placed upon shiftable upper and lower racks (not shown), with the kitchenware being cleaned during a washing operation in a manner widely known in the art. Tub 5 has attached thereto a frontal frame 16 which pivotally supports a door 20 used to seal washing chamber 14 during the washing operation. In connection with the washing operation, door 20 is preferably provided with a detergent tray assembly 23 within which a consumer can place liquid or particulate washing detergent that is dispensed at predetermined portions of a wash cycle. Of course, dispensing detergent in this fashion is known in the art such that this arrangement is only being described for the sake of completeness.

Arranged within tub 5 and, more specifically, mounted within a central opening 27 formed in bottom wall 8, is a pump and filtration assembly 30. In the preferred embodiment shown in FIGS. 1-3, pump and filtration assembly 30 includes a filter housing 33, an annular outer radial outermost strainer 36 (a first filter unit) , and an annular inner radial or course strainer 39 (a second filter unit). A detailed description of the exact structure and operation of pump and filtration assembly 30 will be described more fully below. For the sake of completeness, extending about a frontal portion of pump and filtration assembly 30, at a position raised above bottom wall 8, is a heating element 44. Heating element 44 preferably takes the form of a sheathed, electric resistance-type heating element of a type commonly found in household dishwashers.

In general, pump and filtration assembly 30 is adapted to direct washing fluid to at least a lower wash arm 47 and a supply conduit 51. As depicted, supply conduit 51 includes a substantially horizontal lower section 53 extending away from filter housing 33 of pump and filtration assembly 30, a vertical section 54 which generally extends along rear wall 11, and a generally horizontally extending upper section 55 (FIG. 2) which rotatably supports an upper wash arm 59. Vertical section 54 has attached thereto a wash fluid diverter or manifold 66 which defines upper and lower ports 68 and 69.

Figure 2:
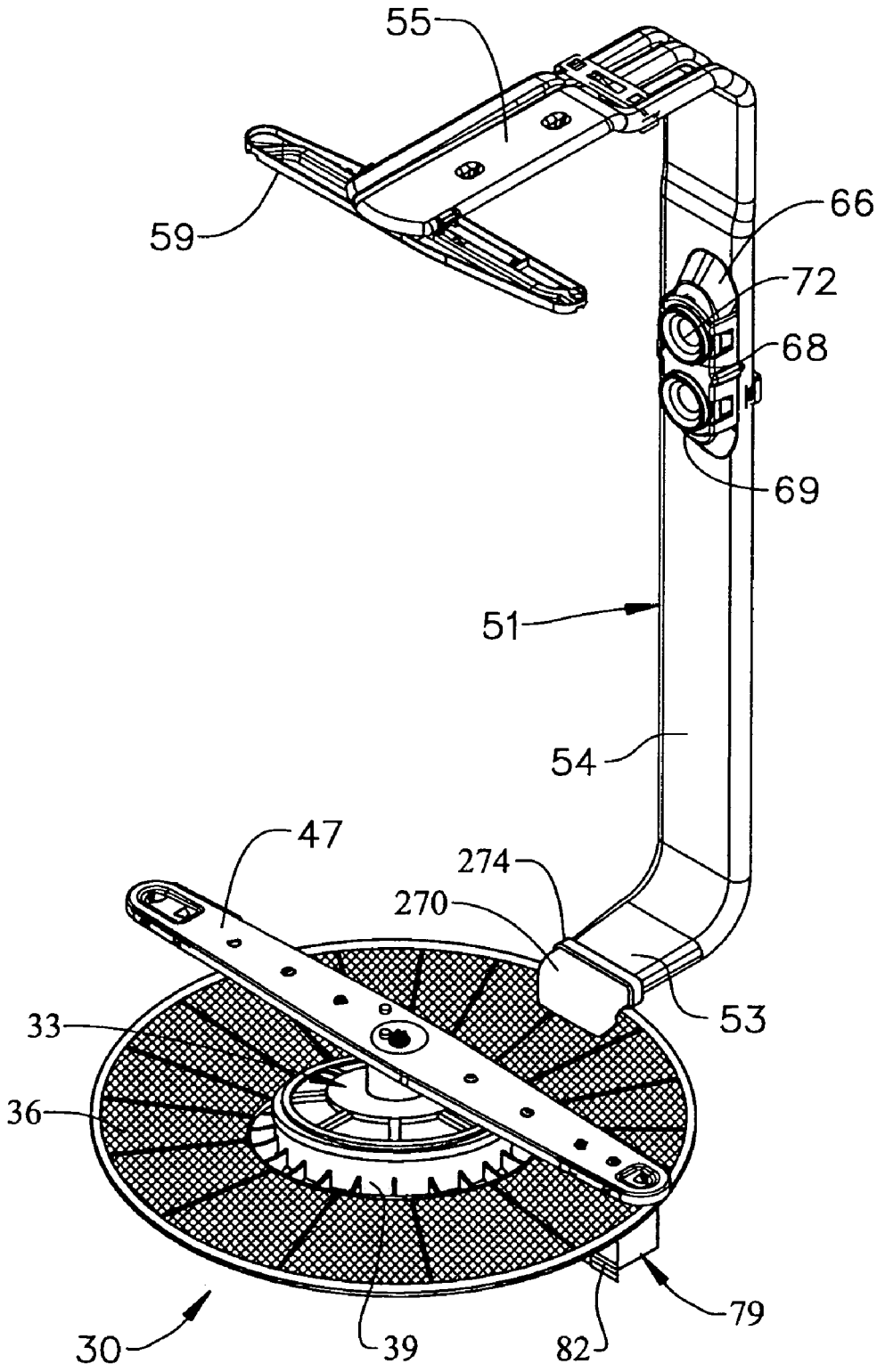
FIG. 2 is a perspective view of an overall pump and filtration system incorporated in the dishwasher of the invention.
Figure 3:
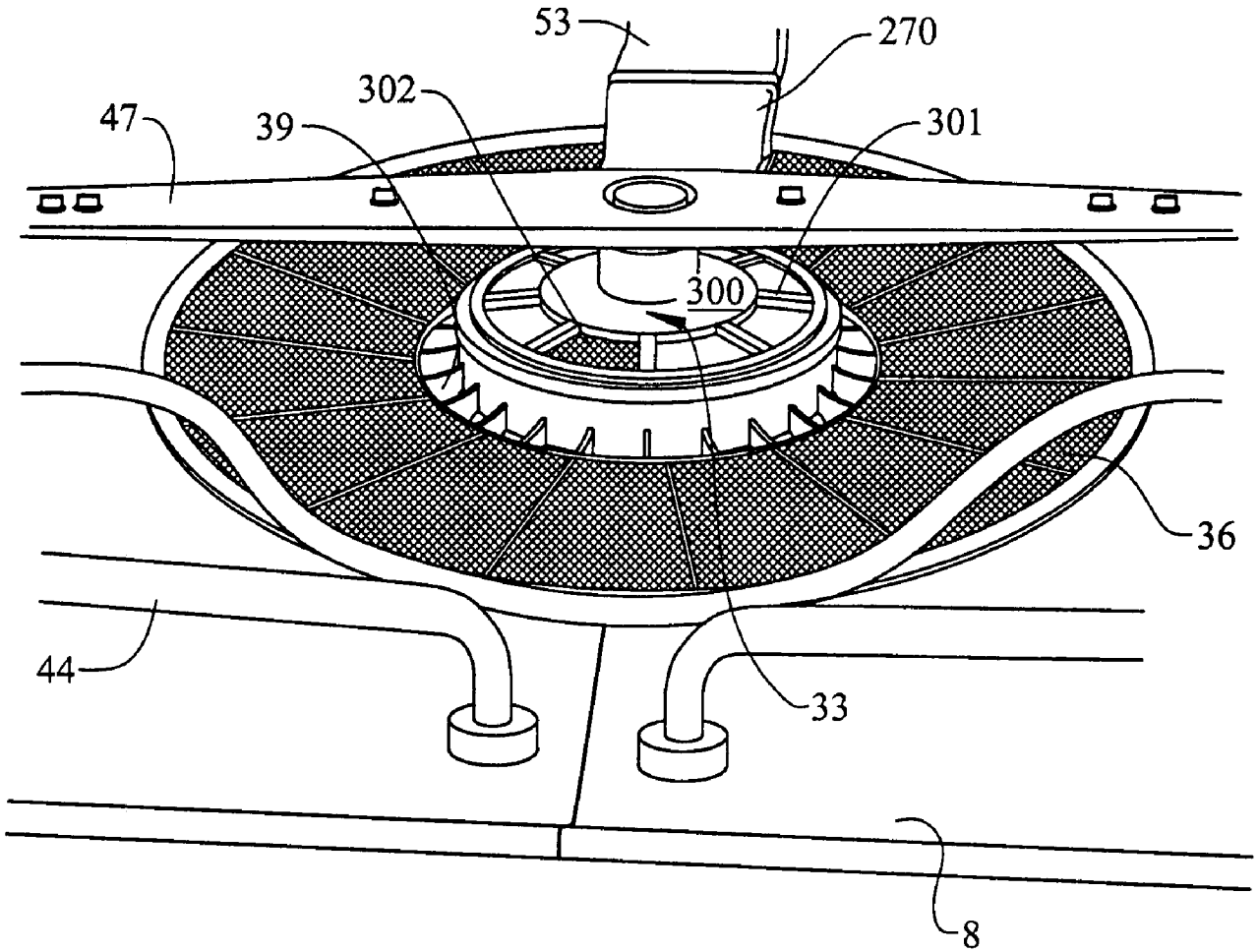
FIG. 3 is an enlarged, partial perspective view of the pump and filtration system as viewed through the open door.

Although not considered part of the present invention, each of upper and lower ports 68 and 69 has associated therewith a valve, such as a flapper element indicated at 72, for preventing any water flowing through supply conduit 51 from exiting either port 68 or 69 unless structure is inserted into a respective port 68, 69 so as to deflect a respective flapper element 72. In general, wash fluid diverter 66 can actually be formed with a varying number of ports ranging from 1 to 3 or more. Wash fluid diverter 66 illustrated in FIG. 2 is actually designed to cooperate with a vertically adjustable upper rack (not shown) which carries an associated underside wash arm and respective piping that becomes aligned with and projects into a respective port 68, 69 in order to deflect flapper element 72. In this manner, an additional wash arm is provided to spray washing fluid upon kitchenware, thereby supplementing lower wash arm 47 and upper wash arm 59 during a washing operation within dishwasher 2. In general, vertically adjustable racks, as well as multi-port wash fluid diverters are known in the art such that this structure will not be described further here.

Pump and filtration assembly 30 has associated therewith a drain pump 79 (see FIGS. 3 and 4) supported in part beneath bottom wall 8 of tub 5 through a suspension bracket 82. Drain pump 79 has associated therewith a drain hose 85 (see FIG. 1) including at least one corrugated or otherwise flexible curved portion 89 that extends about an arcuate hanger 92 provided on an outside surface of side wall 10. Drain hose 85 is also preferably secured to tub 5 through various clips, such as that indicated at 95. In any event, in this manner, an upper loop is maintained in drain hose 85 to assure proper drainage in a manner known in the art.

Figure 4:
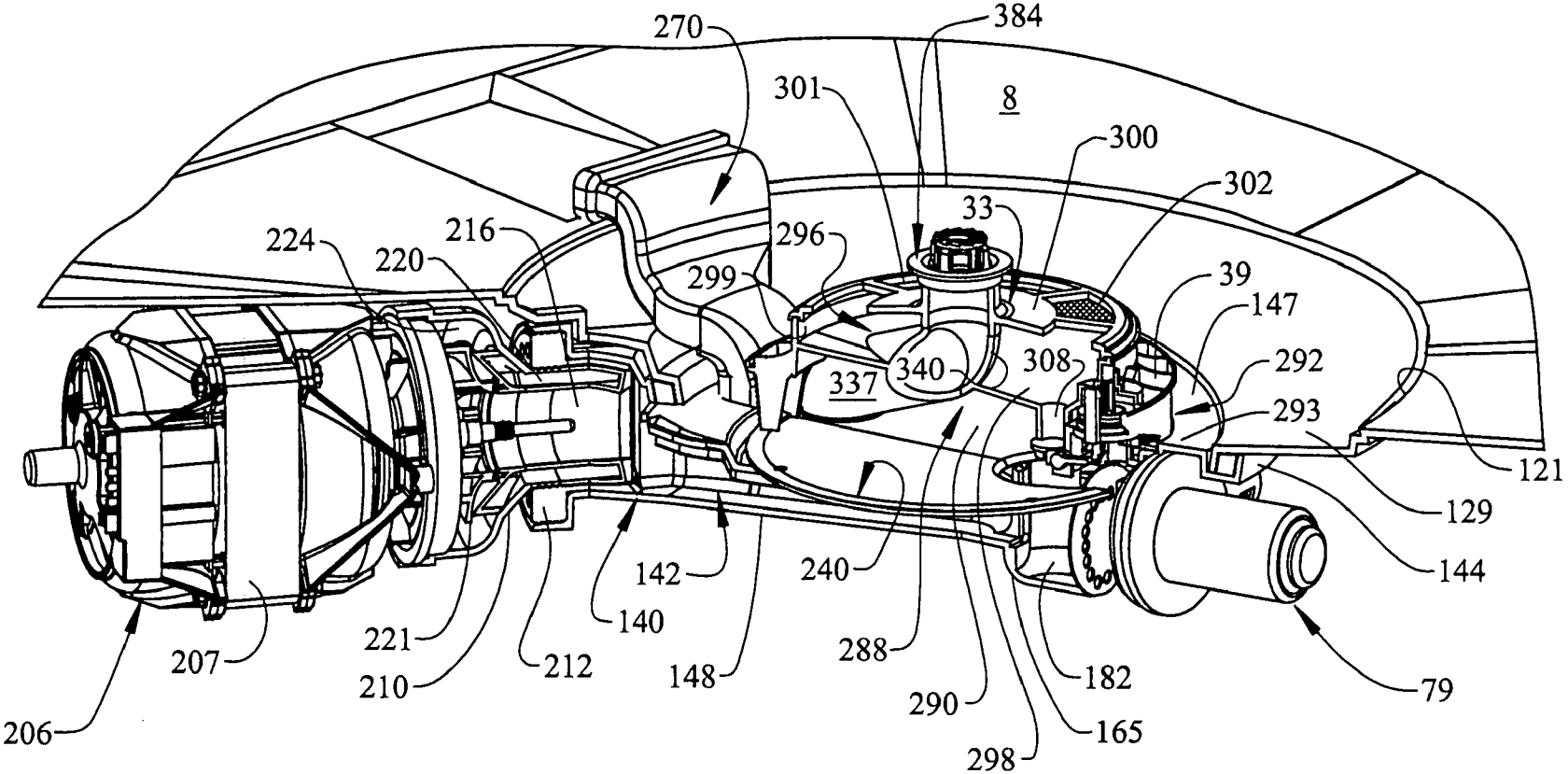
FIG. 4 is a partial, cross-sectional view of the pump and filtration system.

Particular reference will now be made to FIGS. 4-8 in describing further details of pump and filtration assembly 30, as well as other components of dishwasher 2. As best shown in FIG. 4, bottom wall 8 extends to a support flange 121. Support flange 121 is provided to support an outer peripheral edge portion (not separately labeled) of outermost strainer 36. Support flange 121 leads to a central trough 129 that slopes downward toward pump and filtration assembly 30.

Figure 5:
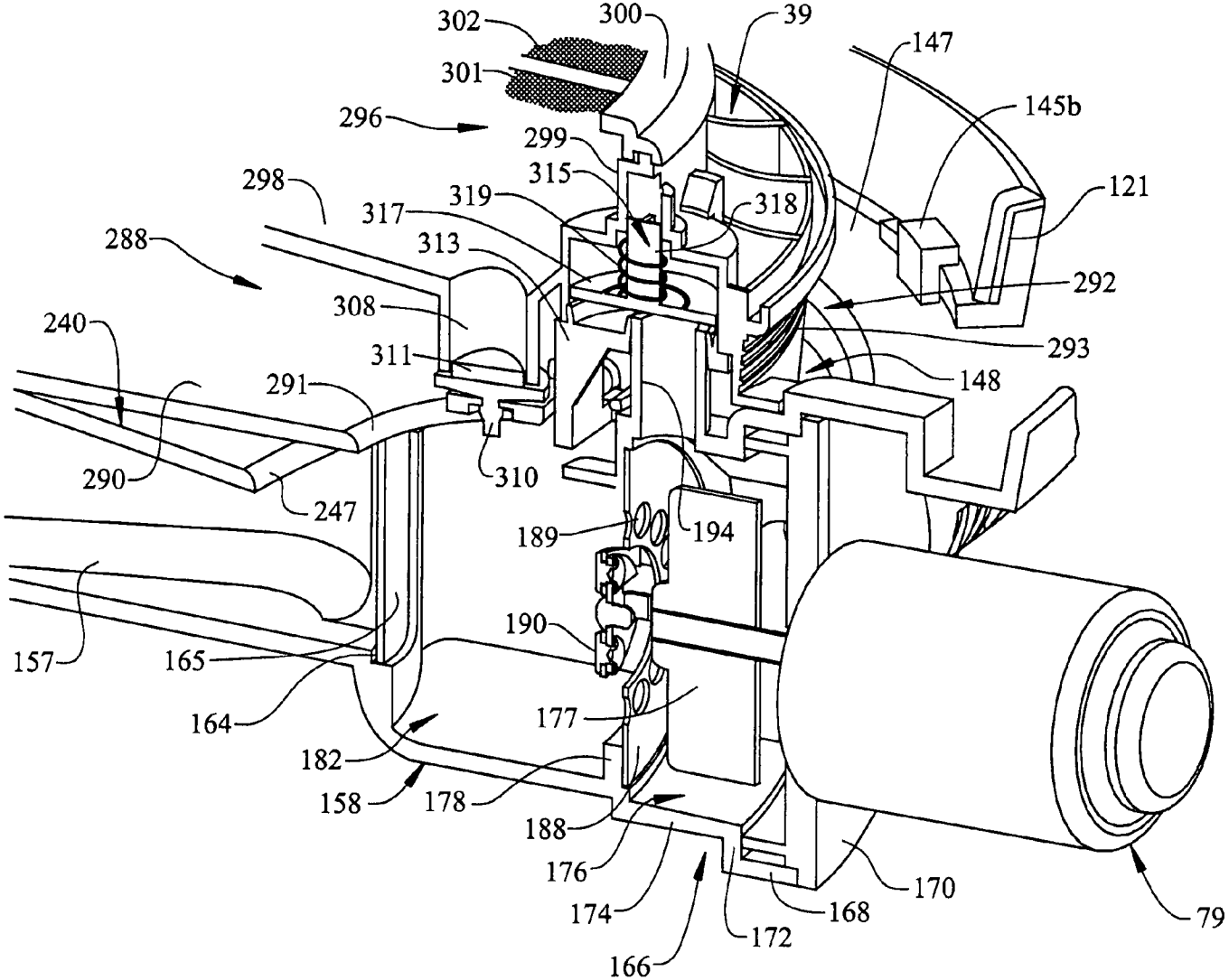
FIG. 5 is an enlarged partial, cross-sectional view illustrating a portion of the pump and filtration system of FIG. 4.
Figure 6:
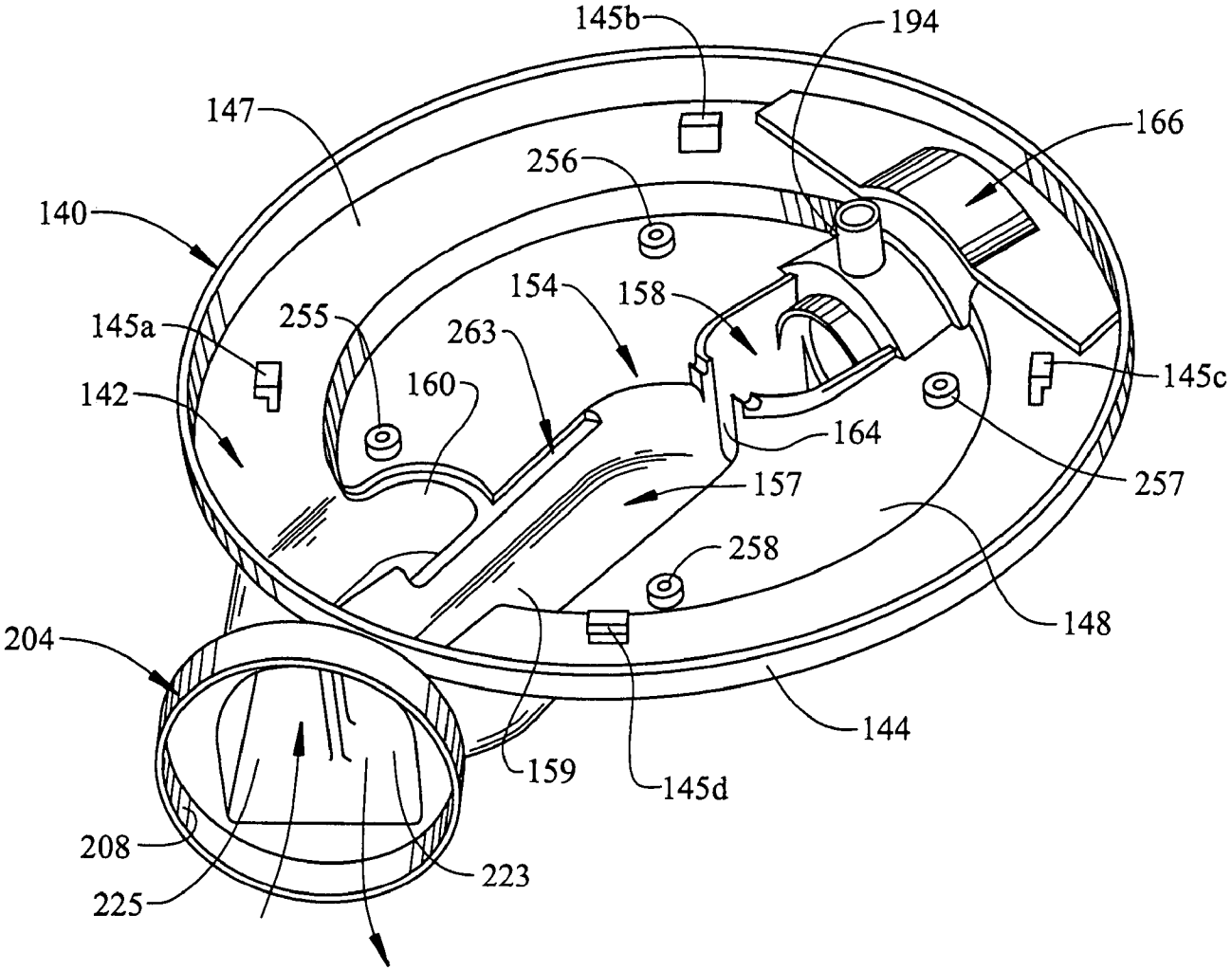
FIG. 6 is an upper perspective view of a pump housing constructed in accordance with the present invention.
Figure 7:
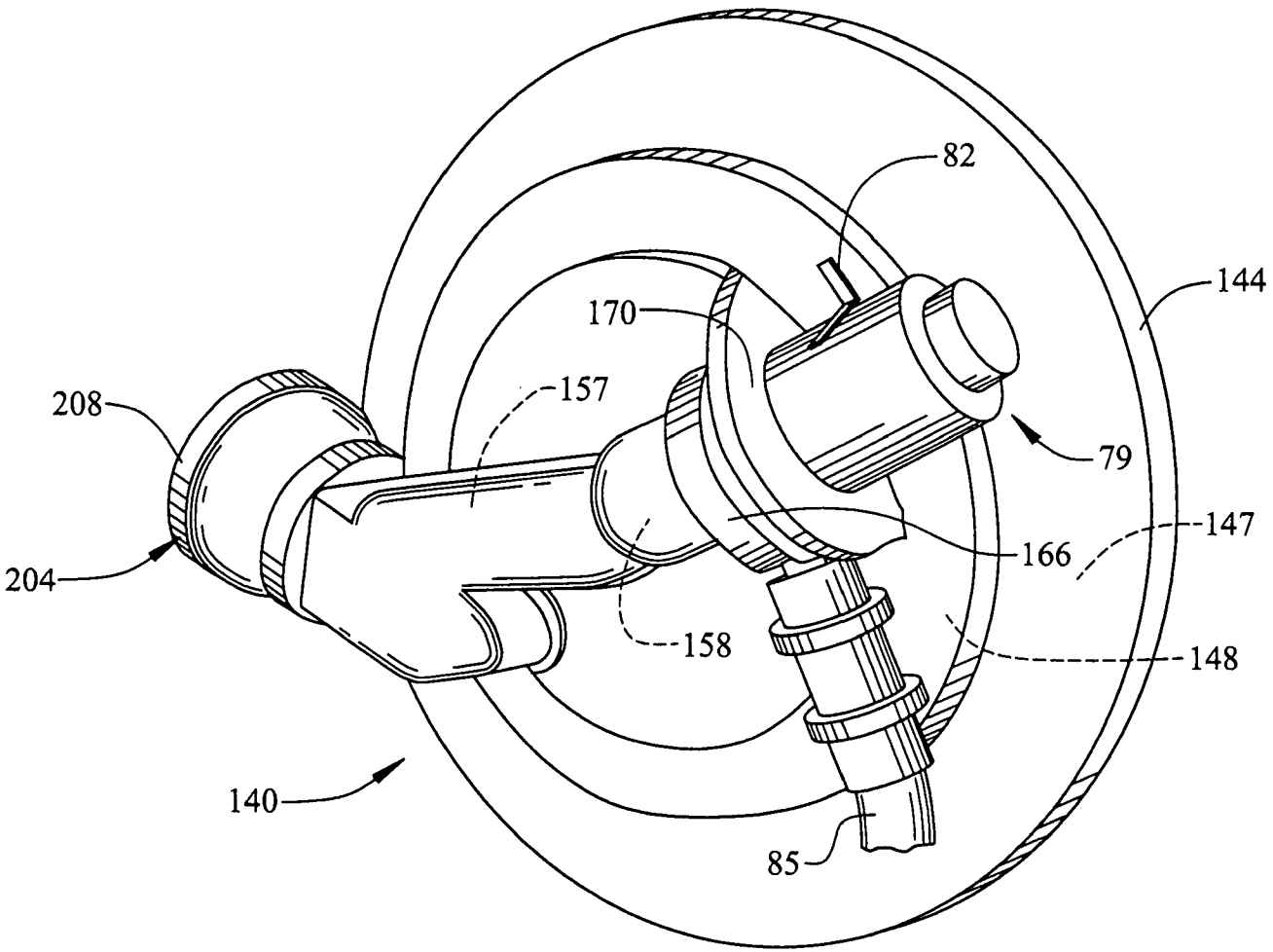
FIG. 7 is a lower perspective view of the pump housing of FIG. 6.

In accordance with a preferred embodiment of the present invention, pump and filtration assembly 30 includes a housing 140 having a central recessed section 142 and an outer edge 144 that is adapted to engage with flange 121 through a plurality of L-shaped projections 145*a-d* (see FIGS. 5 and 6). As best seen in FIG. 6, housing 140 includes a downward sloping upper portion 147 that leads to a lower portion or bottom plate 148. Preferably, formed within lower portion 148 is a washing fluid collection reservoir or pumping chamber 154. In accordance with the most preferred form of the invention, pumping chamber 154 includes a recirculation portion 157 and a discharge/drain portion 158. More specifically, recirculation portion 157 is divided into an inlet passage 159 and an outlet or recirculation passage 160. Preferably, inlet passage 159 and recirculation passage 160 are arranged substantially parallel to one another and extend from outer edge 144 radially inward toward a central portion (not separately labeled) of housing 140. In general, recirculation portion 157 and drain portion 158 extend radially inward from outer edge 144 towards the central portion of housing 140 and interconnect through a passage 164. In accordance with the invention, a flapper valve 165 (not shown in FIG. 6 for clarity, but depicted in FIG. 4) is arranged at passage 164 to prevent washing fluid from passing from drain portion 158 to recirculation portion 157 prior to the activation of drain pump 79.

Figure 9:
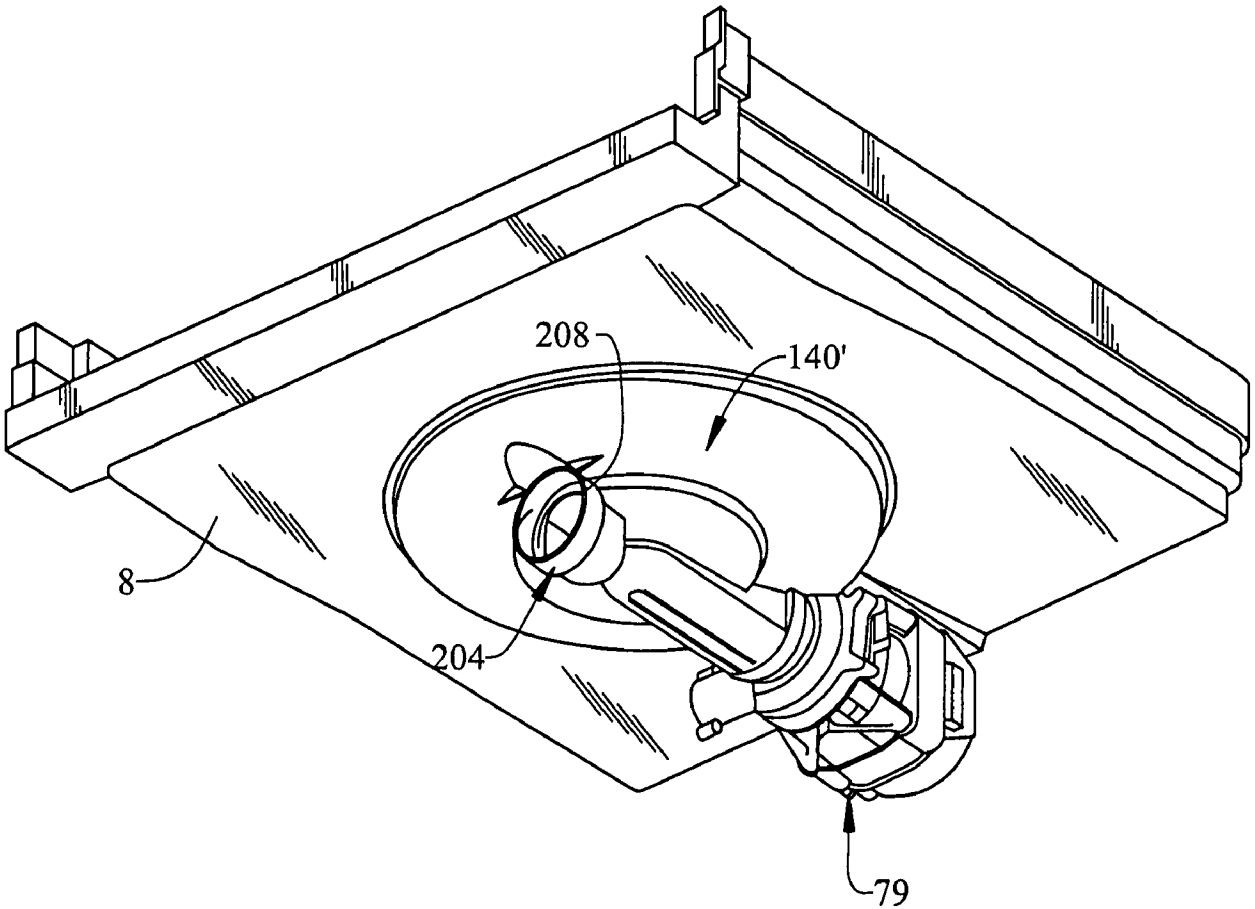
FIG. 9 is a perspective view of a pump housing integrated into a bottom portion of a dishwasher constructed in accordance with a second embodiment of the present invention.

In accordance with a preferred embodiment of the present invention, housing 140 is formed from a single or one-piece injection molded plastic unit (see FIGS. 6 and 7) which facilitates both the manufacturing and the mounting of housing 140 to bottom wall 8 of dishwasher 2. However, in accordance with another embodiment illustrated in FIG. 9, a corresponding housing 140' is actually integrally formed, such as by injection molding, with bottom wall 8 of tub 5.

Referring back to FIGS. 5 and 6, drain portion 158 terminates in a drain pump mount/receiver 166. As best shown in FIG. 5, drain pump mount 166 includes an outer lip portion 168 adapted to receive a mounting plate 170 of drain pump 79. Outer lip portion 168 leads to a first upright wall portion 172 which actually serves as an end stop or sealing portion for mounting plate 170. Extending from first upright wall portion 172 is an intermediate wall portion 174 that defines an impeller chamber 176 having arranged therein an impeller 177 of drain pump 79. Impeller 177 is driven by a pump motor (not separately labeled) to draw washing fluid in from pump and filtration assembly 30 to be directed to drain hose 85. In any event, intermediate wall portion 174 leads to a second upright wall section 178 that separates a collection chamber 182 from impeller chamber 176. In addition, second upright wall section 178 serves as a mounting surface for a chopper plate 188 having a plurality of apertures 189. Actually, a chopper 190, driven by impeller 177, rotates adjacent chopper plate 188, dicing and chopping food particles trapped within collection chamber 182 prior to their release to drain hose 85. Further illustrated in FIG. 5, a conduit 194 extends from an upper portion of impeller chamber 176. With this arrangement, impeller 177 directs a portion of the drain flow upward which, as will be detailed more fully below, operates a mechanism for draining collected fine particles.

In further accordance with the preferred form of the present invention, inlet passage 159 and recirculation passage 160 of recirculation portion 157 collectively terminate in a recirculation pump mount 204 (particularly see FIGS. 4 and 6). As shown, recirculation pump mount 204 is arranged substantially opposite drain pump mount 166. Recirculation pump mount 204 is adapted to receive a recirculation pump 206. Toward that end, recirculation pump mount 204 includes an outer rim portion 208 adapted to support recirculation pump 206 which, in turn, includes a housing 207 that includes a combination inlet/outlet conduit 210. In accordance with the most preferred form of the invention, inlet/outlet inlet/outlet conduit 210 is secured within recirculation pump mount 204 through a gasket 212. Gasket 212 establishes a seal and is provided to minimize the effects of vibration and noise in dishwasher 2. Preferably, gasket 212 is formed from a resilient, elastomeric material that absorbs the various vibrations created by the operation of recirculation pump 206. As best seen in FIGS. 4 and 6, inlet/outlet conduit 210 includes a central inlet portion 216 and an outer sleeve or outlet portion 220. In accordance with the most preferred embodiment, outlet portion 220 is positioned radially about inlet portion 216. With this arrangement, washing fluid is drawn through an inlet section 223 of pump mount 204 and guided into inlet portion 216 of recirculation pump 206. The washing fluid is then drawn passed an impeller 221 that redirects the washing fluid outward through a plurality of directional vanes 224 to outlet portion 220. In the most preferred form of the invention, inlet 216 and outlet 220 are arranged concentrically such that fluid flow reverses direction approximately 180° within inlet/outlet conduit 210 while still flowing coaxially. The washing fluid then travels into a recirculation portion 225 of recirculation pump mount 204, which leads to recirculation passage 160 of housing 140.

Figure 8:
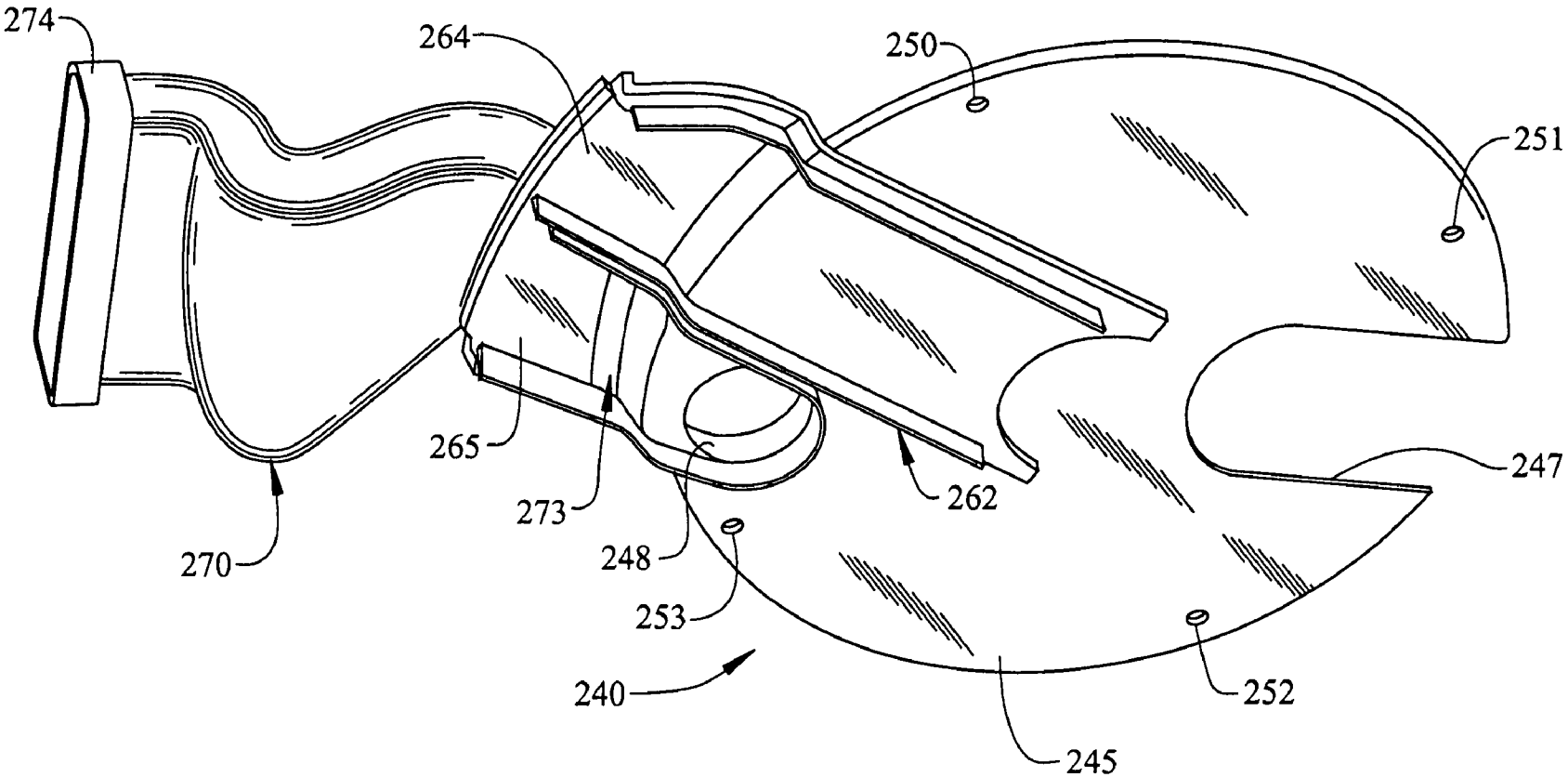
FIG. 8 is a lower perspective view of a flow plate employed with the present invention.

In further accordance with the present invention, arranged within lower portion 148 of housing 140 is a flow or suction plate 240. Referring to FIG. 8, flow plate 240 includes a base portion 245 having a first opening 247 adapted to be positioned above collection chamber 182 (see FIG. 4) and a second opening 248 adapted to be positioned above recirculation passage 160 (FIG. 6). Arranged about base portion 245 are a plurality of apertures 250-253 which are positioned to correspond with an associated plurality of mounting bosses 255-258 (see FIG. 6) that project from lower portion 148 of housing 140. With this arrangement, flow plate 240 is removably secured to housing 140 through a plurality of mechanical fasteners (not shown) that extend through apertures 250-253 and engage into mounting bosses 255-258. Flow plate 240 is also provided with a plurality of raised wall portions, indicated generally at 262. Raised wall portions 262 nest with corresponding structure, indicated generally at 263 in FIG. 6, to define an inlet section 264 and a recirculation section 265. Actually, inlet section 264 and recirculation section 265 respectively correspond to inlet and recirculation passages 159 and 160 of housing 140. In addition, flow plate 240 is provided with a supply conduit 270 that extends from a first end 273, which is open to recirculation section 265, to a second end 274 adapted to interconnect with lower section 53 of supply conduit 51 (see FIG. 2). With this particular arrangement, a portion of the washing fluid being redirected or recirculated from recirculation pump 206 is directed upwardly through opening 273 in supply conduit 270 toward upper wash arm 59 and wash fluid diverter 66, while a separate portion of washing fluid is directed from second opening 248 into lower wash arm 47.

Referring back to FIGS. 4 and 5, arranged above flow plate 240 is a first filter chamber 288. As shown, first filter chamber 288 includes a base portion 290 having an opening 291 positioned above both first opening 247 of flow plate 240 and collection chamber 182. Base portion 290 extends to an upstanding wall portion 292 which, in accordance with the most preferred form of the present invention, includes a filter screen 293. Actually, first filter chamber 288 is fluidly connected to radial, coarse strainer 39 such that water and soil particles traveling over radial outermost strainer 36 enter through strainer 39 and are directed to first filter chamber 288. As will be detailed more fully below, soil and other entrapped particles are carried from filter chamber 288 to soil collection chamber 182, while the washing fluid is directed radially outwardly through filter 293 (a third filter unit) back to tub 5.

Arranged above first filter chamber 288 is a second or fine filter chamber 296. Second or fine filter chamber 296 includes a base portion 298 that extends to a side wall 299 and a cover 300. Preferably, cover 300 is provided with a plurality of enlarged openings 301. As best illustrated in FIGS. 4 and 5, each of enlarged openings 301 has associated therewith a fine mesh screen 302 (a fourth filter unit), preferably having openings in the order of 75 microns to 3 mils, for filtering purposes. Cover 300 is also supports structure that rotatably positions lower wash arm 47 above filter housing 33 as will be discussed more fully below.

In further accordance with the most preferred form of the invention, second or fine filter chamber 296 is provided with a fine particle collection chamber 308 (a second soil collection chamber) for collecting fine soil particles entrapped within fine filter chamber 296. Preferably, fine particle collection chamber 308 is provided with a pivoting cover 310 (see FIG. 5) having a seal or gasket 311. More preferably, cover 310 is pivotally connected to a pivot arm 313 that interconnects cover 310 with a piston 315. As shown, piston 315 is provided with a face portion 317 that extends to a plunger 318 about which is a positioned a spring 319. During a wash cycle, spring 319 maintains cover 310 in a closed position, thereby allowing fine soil particles to accumulate in fine particle collection chamber 308. However, during a drain operation, impeller 177 of drain pump 79 generates a fluid force through conduit 194 that impinges upon face portion 317 of piston 315. At this point, piston 315 is forced upward against the biasing force of spring 319 in order to pivot arm 313 and open cover 310. As fine particle collection chamber 308 is positioned above collection chamber 182, fine soil particles contained within collection chamber 308 pass from fine filter chamber 296 into collection chamber 182 to be directed to drain hose 85.

Referring to FIG. 4, extending through central opening 304 in cover 300 is a central hub portion 334 having arranged thereon a plurality of bearings or the like (not shown) for rotatably supporting lower wash arm 47. Preferably, central hub 334 is in fluid communication with second opening 248 of flow plate 240 through a conduit 337. With this arrangement, a portion of the washing fluid being directed from recirculation pump 206 travels through conduit 337 into lower wash arm 47 and is thereafter directed upward onto kitchenware within dishwasher 2. However, prior to entering lower wash arm 47, conduit 337 is formed with a sampling port 340 which opens into second filter chamber 296.

The manner in which fluid and entrapped particles flow through pump and filtration assembly 30 during operation of dishwasher 2 will now be described. In a manner known in the art, tub 5 will be initially, partially filled with water which can be further heated by activation of heating element 44. During a washing cycle, recirculation pump 206 is operated to concurrently draw in washing fluid from tub 5 and thereafter redirect or recirculate the washing fluid to the various wash arms 47 and 59, as well as wash fluid diverter 66. The spraying of the washing fluid will cause food particles to fall from kitchenware placed in dishwasher 2, while the washing fluid with entrained particles will fall onto bottom wall 8. Initially, a portion of the washing fluid will pass through outermost strainer 36 into central trough 129. This portion of the washing fluid will then pass into upper portion 147 of filter housing 140 and thereafter be directed under flow plate 240 into pumping chamber 154.

A second portion of the washing fluid, as well as soil particles too large to pass through outermost strainer 36, is directed into coarse strainer 39. Coarse strainer 39 leads to first filter chamber 288 such that, as the fluid and particles enter first filter chamber 288, the washing fluid is directed radially outwardly through annular filter 293 into upper portion 147 of filter housing 140. Soil particles too large to pass through filter 293 settle to base portion 290 of filter chamber 288 and eventually are collected within soil collection chamber 182 to be eventually chopped and directed to drain hose 85.

The washing fluid passing into upper portion 147 of housing 140, whether originating from filter chamber 288 or from central trough 129, is guided under flow plate 240 into recirculation portion 157. The washing fluid is actually drawn in through inlet passage 159 and guided to inlet section 223 of recirculation pump mount 204. Due to the presence of flapper valve 165 in passage 164, only fluid contained in recirculation portion 157 is directed into pump 206. The washing fluid then flows into recirculation pump 206 through combination inlet/outlet inlet/outlet conduit 210, passed impeller 221 and is redirected through directional vanes 224 to outlet portion 220 and finally into recirculation passage 160. With this arrangement, a first portion of the washing fluid is diverted to conduit 51 through supply conduit 270. This first portion of the washing fluid is guided to upper wash arm 59, as well as wash fluid diverter 66 and eventually back onto bottom wall 8 of tub 5. A second portion of the washing fluid is guided into second opening 248 in flow plate 240, through conduit 337 toward lower wash arm 47. The washing fluid flowing into lower wash arm 47 will be sprayed upward into tub 5 through nozzles (not separately labeled) provided on lower wash arm 47 in order to direct the fluid upwardly against kitchenware supported upon a lower rack (not shown), and downward as will be discussed more fully below.

With respect to the fluid flowing through conduit 337, a small percentage of this fluid will enter sampling port 340 so as to be directed into second or fine filtering chamber 296. The portion of the fluid that flows into filter chamber 296 will actually be forced to flow around filter chamber 296 to fine particle collection chamber 308. When drain pump 79 is not activated, this fluid and entrained particles can only initially fill up filter chamber 296 and fine particle collection chamber 308. Once chambers 296 and 308 are filled, the fluid will be caused to flow out of filter housing 33 and back into tub 5 through the various enlarged openings 301 provided with fine mesh screen 302. Of course, given the presence of fine mesh screen 302, the fluid re-entering tub 5 from filter chamber 296 will be substantially cleansed of any soil having any substantial particulate size. Any soil particles which are larger than that which can flow through screen 302 will be forced to remain within filter chamber 296 and actually find their way into fine particle collection chamber 308 due to both the current flow created by incoming fluid into filter chamber 296 through sampling port 340 and gravity. The cleansed washing fluid will be mixed with the remaining fluid in tub 5 and, in fact, re-mixed with the recirculated fluid flowing out at least lower wash arm 47 and upper wash arm 59.

With this arrangement, continued recirculation of the washing fluid will assure that most, if not all, of the soil particles will be entrapped and eventually directed to collection chamber 182. Furthermore, by continuing to provide a flow into sampling port 340 and further finely filtering particles entrained in this fluid by means of fine mesh screen 302, the percentage of soil in the recirculated washing fluid actually becomes quite small. Of course, soil will be accumulating within collection chambers 182 and 308, along with a certain percentage in filter chambers 288 and 296. Furthermore, since the fluid is attempting to exit pump and filtration assembly 30 through fine mesh screen 302, the underside of fine mesh screen 302 itself will actually start to accumulate soil and can become clogged. For this purpose, lower wash arm 47 is provided with one or more lower nozzles (not shown) in order to direct a spray of washing fluid downward onto fine mesh screen 302. Therefore, this directed flow will tend to wash particles off fine mesh screen 302 and back into filter chamber 296 and, eventually, to fine particle collection chamber 308.

In accordance with the most preferred embodiment of the present invention, complete drainage operations are performed on a preprogrammed, timed basis. However, additional drain or purging operations can also be performed. In accordance with the invention, an initial drainage sequence is established depending on the dishwashing operation set by the user. For instance, if the user selects a normal wash mode, a fill operation will be performed wherein a certain amount of water, which will vary with dishwasher models (generally in the order to 6.8-8 quarts), is introduced into tub 5. Thereafter, a main wash cycle will be entered. In accordance with the most preferred form of the invention, the main wash cycle is set at 34 minutes. The main wash cycle is then followed by a rinse cycle lasting approximately 25 minutes. Thereafter, a 30 minute dry cycle is entered.

In the alternative, the user can select a dirty wash cycle which would result, for example, in an 8 minute pre-wash, followed by a 28 minute main wash cycle, a pre-rinse of approximately 10 minutes, a main rinse of approximately 25 minutes, and then a 30 minute drying period. With these configurations, the normal and dirty wash cycles would have 2 or 4 fill periods respectively. Correspondingly, there would be 2 or 4 drain operations performed, each being approximately 2 minutes in duration. Therefore, the drainage operations are pre-programmed based on the particular washing cycle selected, i.e., provided at specific lapsed time periods during an overall dishwashing operation.

In any case, during full or partial drainage operations, soil will be removed from collection chamber 182 and fine particle collection chamber 308 when a combination of soil and washing fluid will be directed, through the operation of drain pump 79, into drain hose 85. However, prior to passing into drain hose 85, the soil and washing fluid is directed passed chopper blade 190 which minces, and finely chops any large soil particles contained within the washing fluid prior to their passing through apertures 189 in chopper plate 188. Once the soil particles are chopped to a size such that they can pass through apertures 189, drain pump 79 directs the washing fluid and entrained soil particles to drain hose 85.

During the operation of drain pump 79, flapper valve 165 arranged within passage 164 is forced open by the direction of washing fluid established by drain pump 79. In this manner, any washing fluid and entrained particles contained within recirculation portion 157 of pumping chamber 154 are directed passed chopper plate 188 to drain hose 85. In addition, the force generated by impeller 177 of drain pump 79 forces fluid upwardly into conduit 194, wherein the fluid impinges upon face portion 317 of piston 315. As discussed above, the force of the washing fluid directed upon piston 315 causes pivot arm 313 to open cover 310, thereby enabling fine particles collected within fine particle collection chamber 308 to fall, under the force of gravity, into collection chamber 182. With this particular arrangement, during each drain operation, soil particles contained within each of the filter chambers, as well as the pumping portion of housing 140, are directed from dishwasher 2 into drain hose 85.

Although described with reference to a preferred embodiment of the present invention, it should be readily apparent to one of ordinary skill in the art that various changes and/or modifications can be made to the invention without departing from the spirit thereof. For instance, although fine mesh screen 302 is back washed through the operation of lower wash arm 47, it may occur that the fine mesh screen becomes clogged to a point that the back washing will no longer alleviate the problem. Toward that end, either a pressure release or overflow system can be provided in connection with second filter chamber 296 in order to alleviate this problem. In any event, the above arrangement provides for an extremely compact multi-stage filtering and pump system enabling a recirculation pump to be simultaneously interconnected to inlet and outlet flow portions in a quick and convenient manner. In any event, it should be understood that the invention is only intended to be limited to the scope of the following claims.

I claim:

1. A dishwasher comprising:

a tub including bottom, opposing side, rear and top walls which collectively define a washing chamber adapted to receive soiled kitchenware and a supply of washing fluid;

at least one wash arm adapted to spray the washing fluid onto the kitchenware;

a recirculation pump adapted to supply the at least one wash arm with the washing fluid;

a first filter unit fluidly interposed between the tub and the recirculation pump;

a first filter chamber arranged below the bottom wall of the tub;

a second filter unit fluidly interposed between the tub and the first filter chamber through which the washing fluid, with entrained soil particles, enters the first filter chamber;

a first soil collection chamber opening to the first filter chamber, said first soil collection chamber being adapted to receive the soil particles flowing through the second filter unit;

a third filter unit interposed between the first filter chamber and the recirculation pump;

a second filter chamber spaced from the first filter chamber;

a fourth filter unit interposed between the second filter chamber and the tub;

a conduit fluidly interconnecting the recirculation pump with the at least one wash arm, said conduit extending through the second filter chamber and including a bleed port opening into the second filter chamber;

a second soil collection chamber opening to the second filter chamber, said second soil collection chamber being adapted to receive soil particles filtered from the washing fluid by the fourth filter; and a valve assembly separating the second soil collection chamber from the first soil collection chamber, said valve assembly including a seal member and a pivot arm adapted to open the seal member during a drain portion of a washing operation.

2. A dishwasher comprising:

a tub including bottom, opposing side, rear and top walls which collectively define a washing chamber adapted to receive soiled kitchenware and a supply of washing fluid;

at least one wash arm adapted to spray the washing fluid onto the kitchenware;

a recirculation pump adapted to supply the at least one wash arm with the washing fluid;

a first filter unit fluidly interposed between the tub and the recirculation pump;

a first filter chamber arranged below the bottom wall of the tub;

a second filter unit fluidly interposed between the tub and the first filter chamber through which the washing fluid, with entrained soil particles, enters the first filter chamber;

a third filter unit interposed between the first filter chamber and the recirculation pump;

a second filter chamber spaced from the first filter chamber;

a fourth filter unit interposed between the second filter chamber and the tub.

3. The dishwasher according to claim 2, wherein the first filter unit is arranged radially outward of the second filter unit.

4. The dishwasher according to claim 2, wherein the second filter chamber is positioned above the first filter chamber with said first and second filter chambers sharing a common wall.

5. The dishwasher according to claim 4, wherein the fourth filter unit extends about an upper portion of the second filter chamber.

6. The dishwasher according to claim 5, further comprising: a second wash arm, said recirculation pump outputting a bifurcated flow of washing fluid with one portion of the bifurcated flow entering the conduit and a second portion of the bifurcated flow being directed to the second wash arm.

7. The dishwasher according to claim 2, wherein the third filter unit extends about the first filter chamber with the washing fluid passing radially outward from the first filter chamber into the tub.

8. The dishwasher according to claim 2, wherein the first filter unit is a medium filter, the second filter unit is a coarse filter and the third filter and fourth filter units are fine filters.

9. A dishwasher comprising:

a tub including bottom, opposing side, rear and top walls which collectively define a washing chamber adapted to receive soiled kitchenware and a supply of washing fluid;

at least one wash arm adapted to spray the washing fluid onto the kitchenware;

a recirculation pump adapted to supply the at least one wash arm with the washing fluid;

a first filter unit fluidly interposed between the tub and the recirculation pump;

a first filter chamber arranged below the bottom wall of the tub;

a second filter unit fluidly interposed between the tub and the first filter chamber through which the washing fluid, with entrained soil particles, enters the first filter chamber;

a first soil collection chamber opening to the first filter chamber, said first soil collection chamber being adapted to receive the soil particles flowing through the second filter unit;

a third filter unit interposed between the second filter chamber and the tub;

a second filter chamber spaced from the first filter chamber;

a second soil collection chamber opening to the second filter chamber; and a valve assembly separating the second soil collection chamber from the first soil collection chamber, said valve assembly including a seal member and a pivot arm adapted to open the seal member during select portions of a washing operation.

10. The dishwasher according to claim 9, further comprising: a housing mounted below the tub, said housing including a recirculation portion leading to the recirculation pump and a drain portion.

11. The dishwasher according to claim 10, further comprising: a drain pump, said drain pump being connected to the drain portion of the housing.

12. The dishwasher according to claim 11, wherein the first soil collection chamber is positioned in the drain portion of the housing.

13. The dishwasher according to claim 11, further comprising: a chopper blade, said chopper blade being arranged between the first soil collection chamber and the drain pump.

14. The dishwasher according to claim 11, wherein operation of the drain pump forces a flow of washing fluid to open the seal member.

15. A dishwasher comprising:

a tub including bottom, opposing side, rear and top walls which collectively define a washing chamber adapted to receive soiled kitchenware and a supply of washing fluid;

at least one wash arm adapted to spray the washing fluid onto the kitchenware;

a recirculation pump adapted to supply the at least one wash arm with the washing fluid;

a first filter unit fluidly interposed between the tub and the recirculation pump;

a first filter chamber arranged below the bottom wall of the tub;

a second filter unit fluidly interposed between the tub and the first filter chamber through which the washing fluid, with entrained soil particles, enters the first filter chamber;

a first soil collection chamber opening to the first filter chamber, said first soil collection chamber being adapted to receive the soil particles flowing through the second filter unit;

a third filter unit interposed between the first filter chamber and the recirculation pump;

a second filter chamber spaced from the first filter chamber;

a conduit fluidly interconnecting the recirculation pump with the at least one wash arm, said conduit extending through the second filter chamber and including a bleed port opening into the second filter chamber.

16. The dishwasher according to claim 15, further comprising: a housing mounted below the tub, said housing including a recirculation portion leading to the recirculation pump and a drain portion.

17. The dishwasher according to claim 16, further comprising: a flow plate positioned above the housing, said flow plate interconnecting the recirculation pump and the conduit.

18. The dishwasher according to claim 17, further comprising: a second wash arm, said recirculation pump outputting a bifurcated flow of washing fluid with one portion of the bifurcated flow entering the conduit and a second portion of the bifurcated flow being directed to the second wash aim.

* * * * *